US010070728B2

(12) United States Patent
Piretti

(10) Patent No.: US 10,070,728 B2
(45) Date of Patent: Sep. 11, 2018

(54) FLEXIBLE CHAIR

(71) Applicant: PRO-CORD S.p.A., Bologna (IT)

(72) Inventor: Alessandro Piretti, Bologna (IT)

(73) Assignee: PRO-CORD S.P.A., Bologna (IT)

( * ) Notice: Subject to any disclaimer, the term of this patent is extended or adjusted under 35 U.S.C. 154(b) by 0 days.

(21) Appl. No.: 15/175,253

(22) Filed: Jun. 7, 2016

(65) Prior Publication Data

US 2016/0360891 A1 Dec. 15, 2016

(30) Foreign Application Priority Data

Jun. 11, 2015 (IT) ..... 102015000022850

(51) Int. Cl.

| | |
|---|---|
| ***A47C 3/026*** | (2006.01) |
| ***A47C 7/44*** | (2006.01) |
| ***A47C 3/12*** | (2006.01) |
| ***A47C 7/14*** | (2006.01) |
| ***A47C 7/16*** | (2006.01) |

(52) U.S. Cl.

CPC ..... *A47C 7/44* (2013.01); *A47C 3/026* (2013.01); *A47C 3/12* (2013.01); *A47C 7/14* (2013.01); *A47C 7/16* (2013.01)

(58) Field of Classification Search

CPC .. A47C 7/44; A47C 3/026; A47C 3/12; A47C 7/14; A47C 7/16

See application file for complete search history.

(56) References Cited

U.S. PATENT DOCUMENTS

| | | | | |
|---|---|---|---|---|
| 4,856,846 A * | 8/1989 | Lohmeyer | ..... | A47C 3/12 297/285 |
| 4,871,208 A * | 10/1989 | Hodgdon | ..... | A47C 3/026 248/575 |
| 5,577,811 A * | 11/1996 | Ogg | ..... | A47C 3/12 297/284.4 |
| 6,634,717 B2 * | 10/2003 | Kown | ..... | A47C 3/023 297/160 |
| 7,600,820 B2 * | 10/2009 | Bouche | ..... | A47C 3/04 297/452.14 |

FOREIGN PATENT DOCUMENTS

| | | |
|---|---|---|
| DE | 102009022416 A1 | 8/2010 |
| EP | 0242433 A2 | 10/1987 |

OTHER PUBLICATIONS

Italian Search Report and Written Opinion dated Dec. 18, 2015 for Application No. ITUB20151164.

* cited by examiner

*Primary Examiner* — Philip F Gabler

(74) *Attorney, Agent, or Firm* — Patterson & Sheridan, LLP

(57) ABSTRACT

A chair comprising: a support structure including a rigid front fixing element, and an essentially L-shaped seating element, including a seat portion and a backrest portion connected to each other via an arcuate connecting portion, wherein the seat portion comprises a front fixing section fixed to said rigid front fixing element, a main seat section having a concave cross-section and a planar bending section located between said front fixing section and said main seat section and having a flat cross-section.

6 Claims, 5 Drawing Sheets

FLEXIBLE CHAIR

CROSS-REFERENCE TO RELATED APPLICATIONS

This application claims benefit of Italian patent application number 102015000022850, filed Jun. 11, 2015, which is herein incorporated by reference.

BACKGROUND OF THE INVENTION

Field of the Invention

The present invention relates to a chair comprising a support structure and a flexible seating element capable of deforming elastically backwards under the user's weight.

Description of Prior Art

In the state of the art, chairs equipped with an elastically deformable backrest capable of assuming a rest position and a backwardly inclined position are very widespread. Simpler chairs have the seat fixed and the backrest elastically inclinable backwards. Chairs are also known, typically office chairs, provided with mechanisms that synchronize the tilting movement of the seat and the backrest to generate the required comfort. Chairs of this type offer a high comfort due to the synchronized movement of the seat and of the backrest, but have the drawback of a greater complexity due to the mechanism that synchronizes the movements of the seat and the backrest.

SUMMARY OF THE INVENTION

The present invention aims to provide a chair devoid of mechanisms and that offers characteristics of comfort comparable to those of traditional chairs with synchronized seat and backrest.

According to the present invention, this object is achieved by a chair having the characteristics forming the subject of claim 1.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
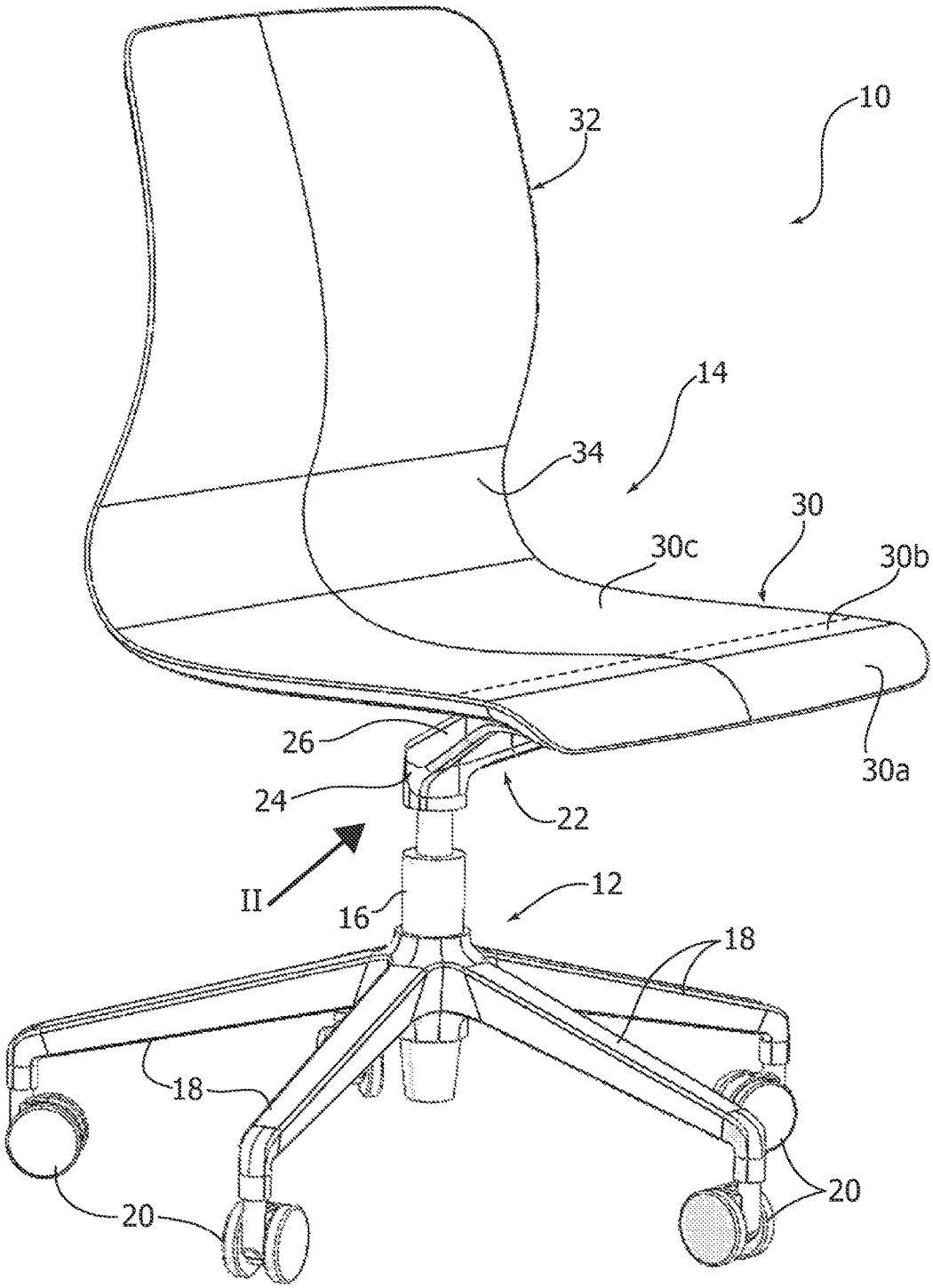
FIG. 1 is a perspective view of a chair according to the present invention.

With reference to the figures, numeral 10 designates a chair according to the present invention. The chair 10 comprises a base structure 12 and a seating element 14 fixed to the base structure 12. In the illustrated example, the base structure 12 comprises a central column 16 rotatable about a vertical axis, carried by a plurality of arms 18 equipped at their ends with pivoting wheels 20. A base structure of this type is not, however, mandatory and can be replaced by base structures of different kinds depending on requirements. For example, the chair according to the present invention can be provided with a base structure with four legs or with a cantilever frame.

Figure 3:
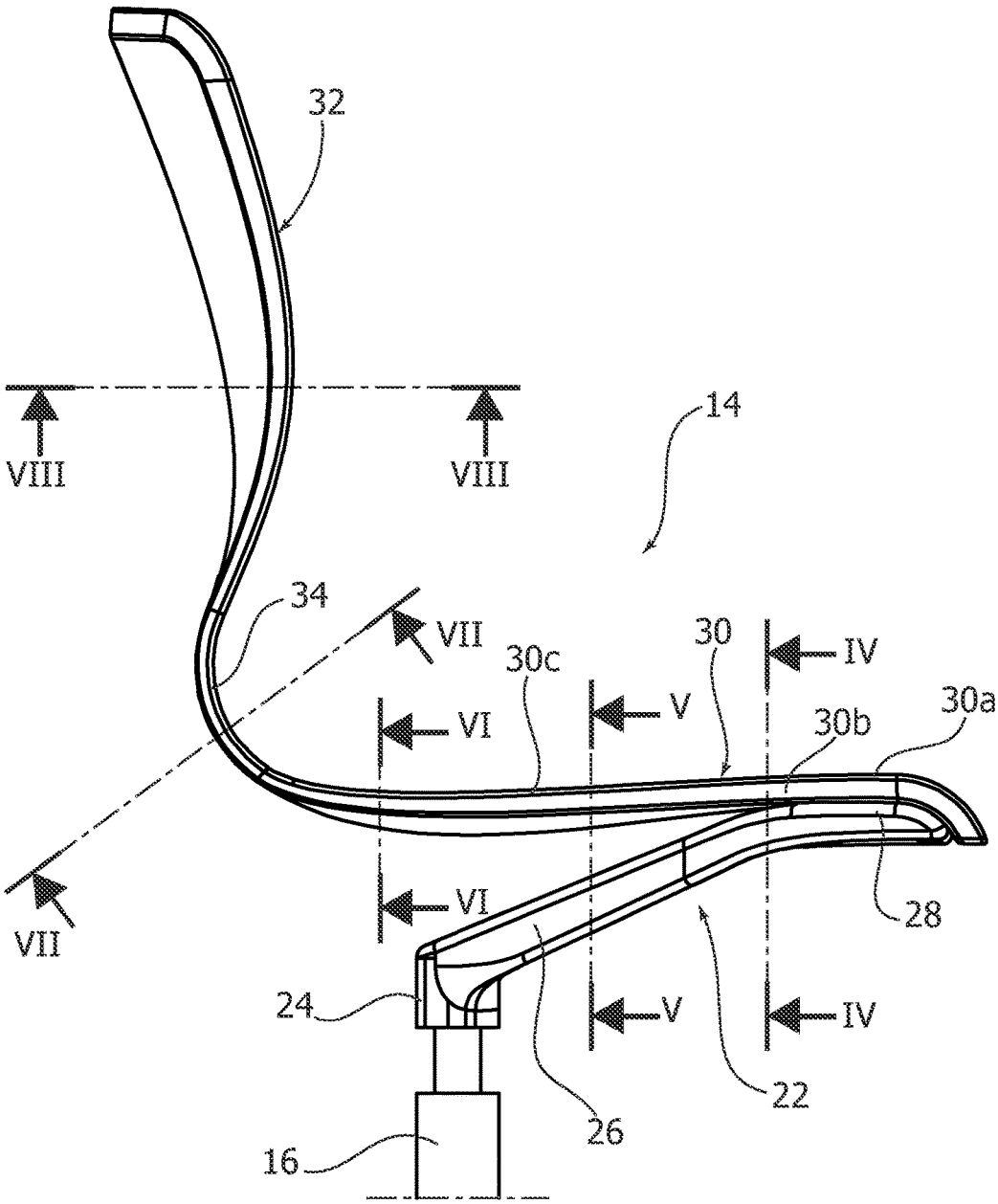
FIG. 3 is a side view of the chair of FIG. 1.
Figure 9:
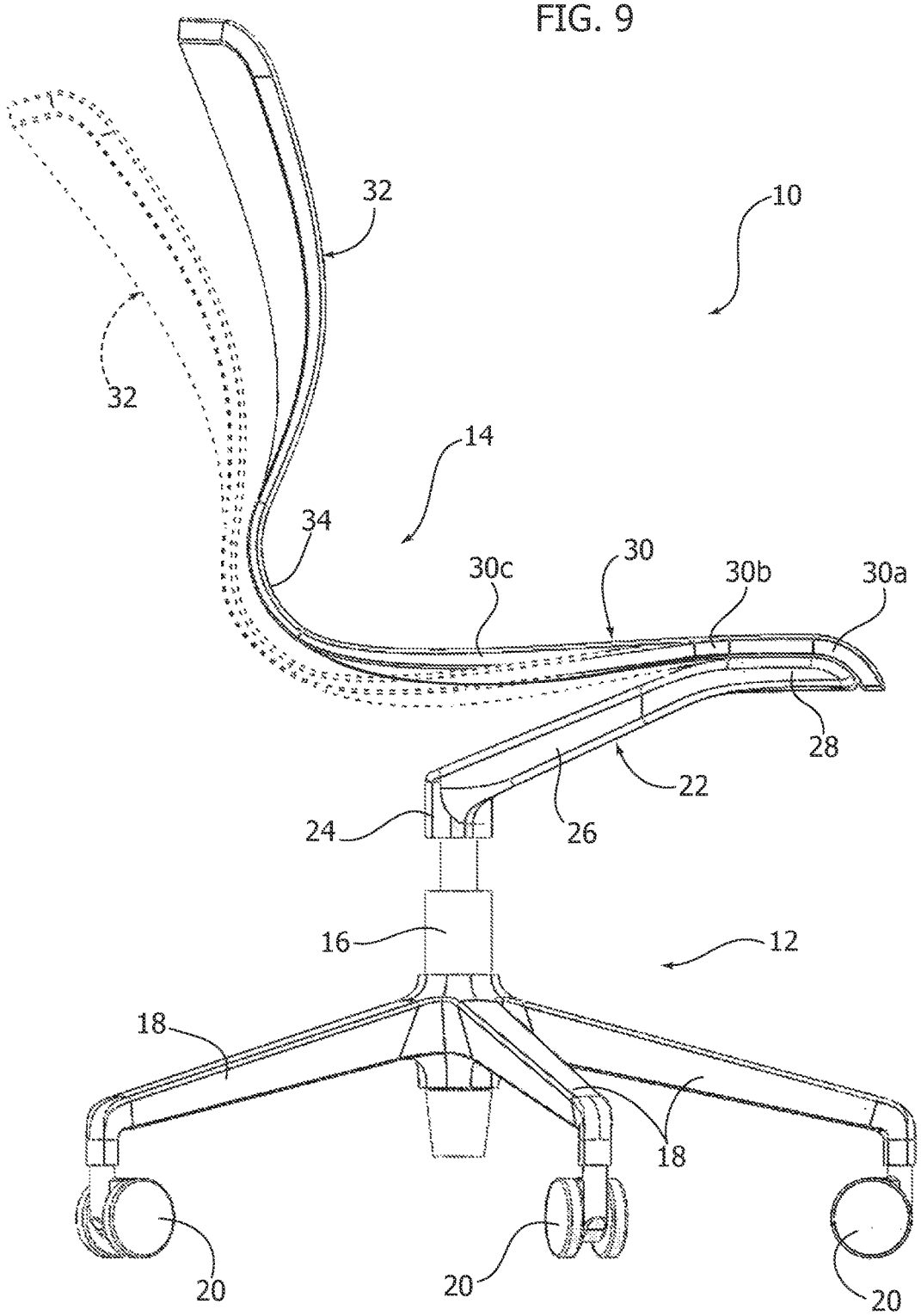
FIG. 9 is a side view illustrating the chair of FIG. 1 in a rest position and in a backwardly inclined position.

A rigid fixing element 22 is fixed to the upper end of the rotatable column 16. The rigid fixing element 22 is preferably made of metal, for example, a light die-cast alloy, and comprises—in one piece—a hub 24 fixed to the central column 16, two arms 26 that extend in a cantilevered manner from the hub 24 in a generally V-shaped configuration and a front plate 28, which joins together the outer ends of the arms 26. Alternatively, the rigid fixing element 22 can have a single arm 26, in a central position with respect to the front plate 28 according to a general T-shaped configuration. The front plate 28 is spaced apart in the horizontal direction with respect to the vertical axis of the rotatable column 16. With reference to FIGS. 3 and 9, the arms 26 extend upwardly starting from the hub 24, so that the front plate 28 is located at a greater height with respect to the upper end of the central column 16.

The seating element 14 is essentially L-shaped and is preferably formed of a single piece of injection-molded plastic material. Preferably, the seating element 14 is made of compact polyurethane. This material has different mechanical characteristics from the plastic materials commonly used in the sector of chairs and, in particular, proves very effective for designing elements with cross-sections of reduced dimensions, but with high rigidity and excellent elastic memory. The seating element 14 may be produced using other plastic materials with good elastic memory, such as, for example, nylon or the like.

The seating element 14 comprises a seat portion 30 and a backrest portion 32, connected together by an arcuate connecting portion 34. The arcuate connecting portion 34 has an upper portion integral with a lower portion of the backrest portion 32 and a lower portion integral with a rear portion of the seat portion 30.

Figure 2:
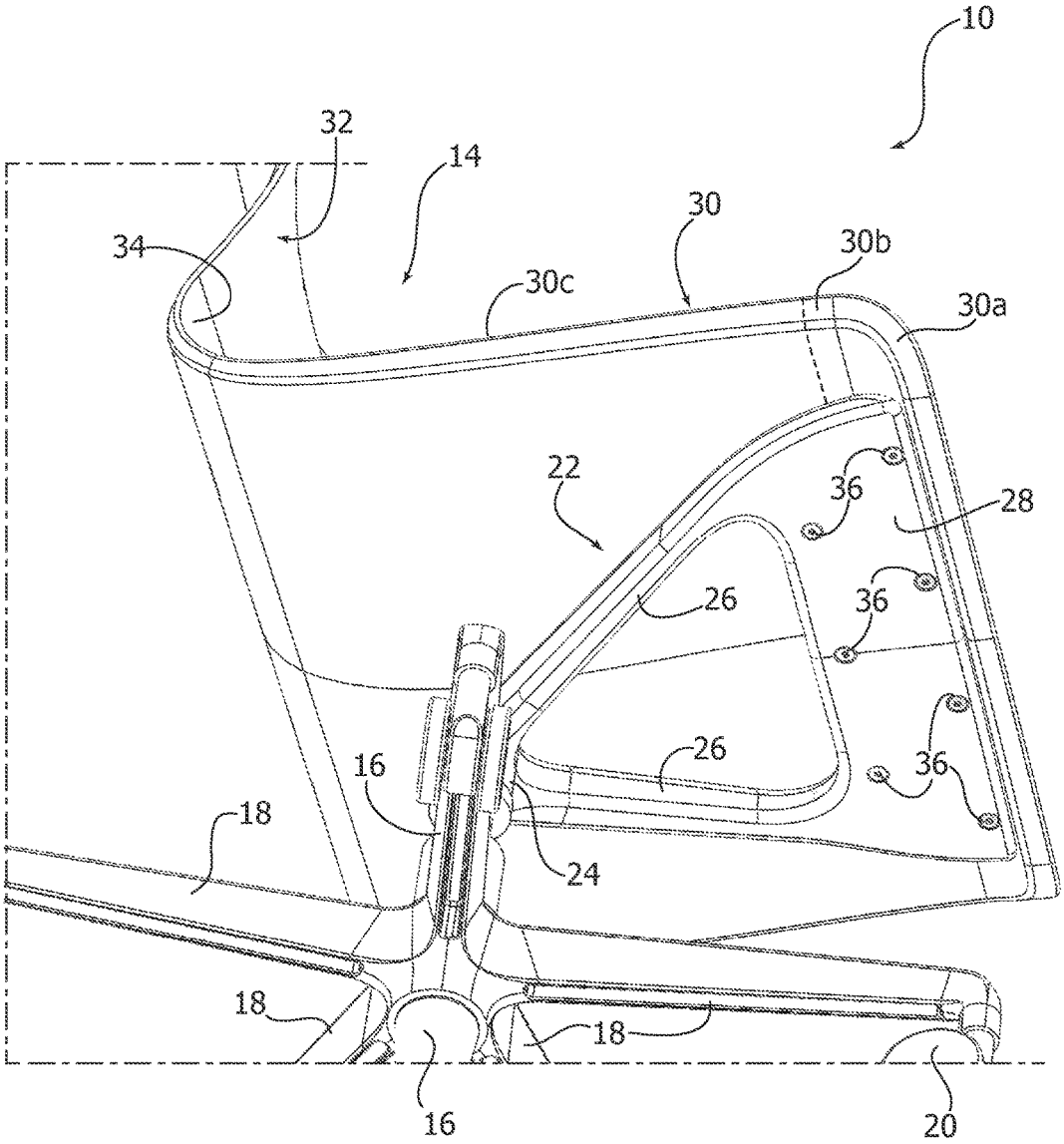
FIG. 2 is a perspective view of the part indicated by the arrow II in FIG. 1.
Figure 4:
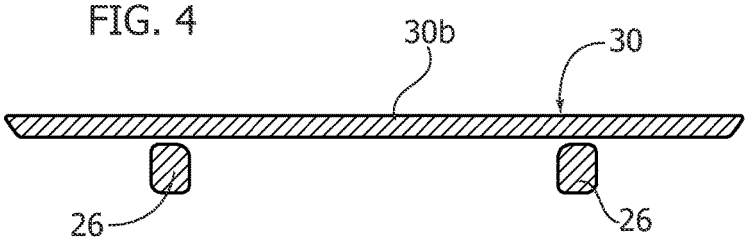
FIGS. 4, 5, 6, 7 and 8 are sections according to the lines IV-IV, V-V, VI-VI, VII-VII and VIII-VIII of FIG. 3, respectively.
Figure 5:
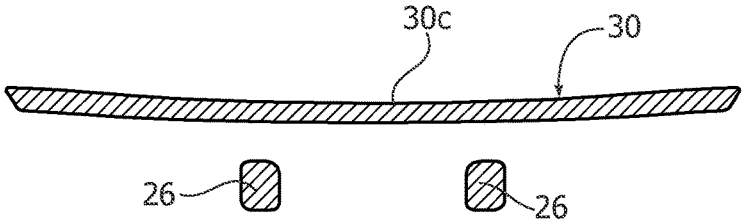

The seat portion 30 is, in turn, subdivided into three sections: a front fixing section 30*a*, a planar bending section 30*b* and a main section 30*c*. The front fixing section 30*a* rests on the upper surface of the front wall 28 of the rigid fixing element 22 and is fixed to the rigid fixing element 22 by means of screws 36 (FIG. 2). The planar bending section 30*b* extends transversely and is positioned in the longitudinal direction between the front fixing section 30*a* and the main seat section 30*c*. With reference to FIGS. 3 to 5, the planar bending section 30*b* is slightly spaced apart in the vertical direction from the arms 26 of the rigid fixing element 22. The central seat section 30*c* is widely spaced apart in the vertical direction from the arms 26 and from the hub 24 of the rigid fixing element 22.

Figure 6:
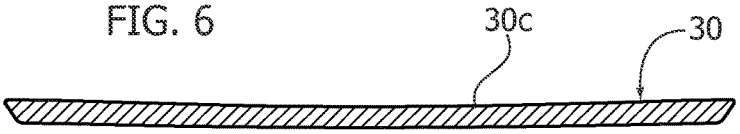
Figure 7:
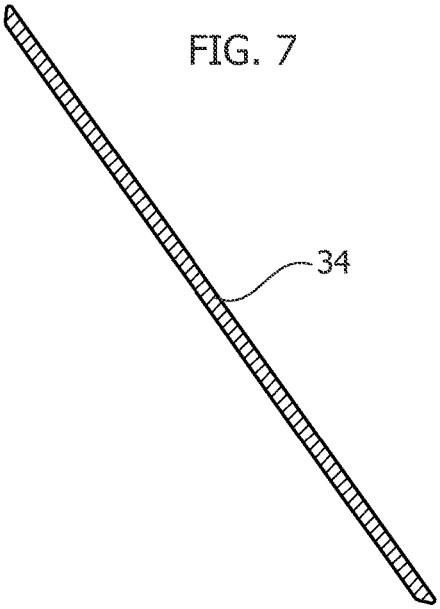

With reference to FIGS. 4 to 6, in a cross section, the planar bending section 30*b* of the seat portion 30 is flat. More precisely, in cross-section, the planar bending section 30*b* has a thin profile with two main flat walls parallel to each other (FIG. 4). With reference to FIGS. 5 and 6, in cross-section, the main seat section 30*c* has a concave shape. More precisely, in cross-section the main seat section 30*c* has a flattened shape with two curved main walls with their respective concavities facing upwards.

The planar bending section 30*b* has a much lower bending rigidity than that of the main seat section 30*c*, so that the seating element 14 can flex around a transverse axis passing through the planar bending section 30*b*. The concave shape of the main seat section 30*c* makes the seating element 14 much more rigid and essentially non-deformable by bending at the main seat section 30*c*.

Figure 8:
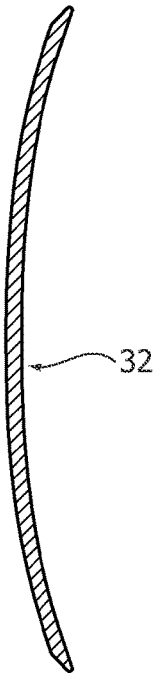

With reference to FIG. 8, the backrest portion 32 has a concave shape with the concavity facing forwards. More precisely, in cross-section, the backrest portion 32 has a thin profile with two main curved walls with the respective concavities facing forwards. Preferably, the arcuate connecting portion 34 has a flat shape in cross-section, with two main walls parallel to each other. In this way, the backrest portion 32 can flex backwards with respect to the seat portion 30 since the flat shape in cross-section of the arcuate connecting portion 34 has a low bending rigidity. The backrest portion 32 is instead essentially non-deformable by bending because the concave cross-section has a high bending rigidity.

Ergonomic studies have shown that the comfort of a chair increases as the fulcrum of tilting of the seat is advanced, ideally in close proximity to the user's knees. In the solution according to the present invention, the transverse tilting axis of the seat portion 30 is at the planar bending section 30*b*, which is immediately adjacent to the front fixing portion 30*a*. Therefore, the tilting axis of the seat portion 30 is in a very advanced position, which is advantageous for the comfort of the tilting movement of the seat portion 30. The main seat section 30*c* has a concave cross-section between the planar bending section 30*b* and the arcuate connecting portion 34. This concavity is ergonomically functional to the seating comfort and makes this part of the seat portion 30 practically non-deformable by bending.

The arcuate connecting portion 34 has a flat cross-section and therefore has a low bending rigidity. This allows the obtainment of a bending zone of the backrest portion 32 in an ergonomically favorable area, next to the hips of the user. The backrest portion 32 has a concave cross-section, which makes the backrest more comfortable for supporting the user's back and at the same time increases the bending rigidity of the backrest portion 32 and minimizes the elastic deformation.

FIG. 9 shows the seating element 14 of the chair according to the present invention with the rest position marked by a continuous line and the deformed position marked with a dotted line. It can be noted that the elastic deformation of the seating element 14 is given by the sum of the bending deformation of the seat portion 30 around the planar bending section 30*b* and of the elastic deformation of the arcuate connecting portion 34. The seating element 14 returns to the rest position when the backward thrust applied by the user ceases, thanks to the elastic characteristics of the material.

Of course, without prejudice to the principle of the invention, the details of construction and the embodiments can be widely varied with respect to those described and illustrated, without thereby departing from the scope of the invention as defined by the claims that follow.

The invention claimed is:

1. A chair comprising:

a support structure including a rigid front fixing element, said rigid front fixing element comprises a hub, at least one arm that extends in a cantilevered manner from the hub, and a fixing plate located at an outer end of said at least one arm; and an essentially L-shaped seating element, including a seat portion and a backrest portion connected to each other via an arcuate connecting portion having an upper portion integral with a lower portion of the backrest portion and a lower portion integral and directly connected with a rear portion of the seat portion, wherein the seat portion comprises a front fixing section rigidly fixed to said rigid fixing element, a main seat section having a concave cross-section and a planar bending section located between said front fixing section and said main seat section and having a flat cross-section;

and wherein:

said front fixing section, main seat section, and planar bending section are aligned with each other along a common plane; and said fixing plate is fixed to a frontmost edge of the front fixing section.

2. A chair according to claim 1, wherein said arcuate connecting portion has a flat cross-section.

3. A chair according to claim 1, wherein said backrest portion has a concave cross-section.

4. A chair according to claim 1, wherein said at least one arm projects upwardly from said hub.

5. A chair according to claim 4, wherein said planar bending section of the seat portion is vertically spaced apart from said rigid front fixing element.

6. The chair according to claim 1, wherein the at least one arm comprises two arms that extend in a generally V-shaped configuration.

* * * * *